US006532705B1

(12) United States Patent
Gorman

(10) Patent No.: US 6,532,705 B1
(45) Date of Patent: Mar. 18, 2003

(54) BACK-UP SHEAR PLATE FOR METAL FRAME WINDOWS

(75) Inventor: Christopher A. Gorman, Ft. Lauderdale, FL (US)

(73) Assignee: Store Front Supplies, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/321,025

(22) Filed: May 27, 1999

(51) Int. Cl.[7] ..... E06B 1/60; E06B 1/56
(52) U.S. Cl. ..... 52/213; 52/212
(58) Field of Search ..... 52/212, 213, 205, 52/204.69, 656.5

(56) References Cited

U.S. PATENT DOCUMENTS

| | | | | | |
|---|---|---|---|---|---|
| RE19,946 | E | * | 4/1936 | Dawson | 52/205 |
| 2,570,169 | A | * | 10/1951 | Verhagen | 52/204.595 |
| 3,869,839 | A | * | 3/1975 | Johnson et al. | 52/204.69 |
| 4,068,432 | A | * | 1/1978 | Davis | 52/205 |
| 4,628,648 | A | * | 12/1986 | Winyard | 52/204.54 |
| 4,835,927 | A | * | 6/1989 | Michlovic | 52/204.597 |
| 5,491,940 | A | * | 2/1996 | Bruchu | 52/213 |
| 5,655,342 | A | * | 8/1997 | Guillemet et al. | 52/217 |
| 6,006,489 | A | * | 12/1999 | Zadok | 52/773 |
| 6,012,258 | A | * | 1/2000 | Brown et al. | 52/239 |
| 6,058,667 | A | * | 5/2000 | MacDonald et al. | 52/239 |
| 6,067,760 | A | * | 5/2000 | Nowell | 52/204.57 |
| 6,088,979 | A | | 7/2000 | Neal | |

* cited by examiner

*Primary Examiner*—Gregory J. Strimbu
(74) *Attorney, Agent, or Firm*—Robert C. Kain, Jr.; Fleit Kain

(57) ABSTRACT

A plastic back-up shear plate is laterally disposed with a spring fit into the outwardly facing mouth of a metal window frame. The outwardly facing mouth is formed and defined by the window frame. The window frame is an elongated hollow body with opposing outer wall elements which define the outwardly facing mouth. The shear plate is snap fit into the mouth. The shear plate has laterally disposed opposite outer edge portions which are interlockable on the outer wall elements which define the mouth of the window frame. The shear plate has a lateral dimension slightly larger than the lateral mouth dimension which causes the shear plate to snap fit into the mouth with the spring fit. In one embodiment, the shear plate includes support ribs. In another embodiment, the outer base face of the shear plate includes at least one, and preferably two, shim elements which rise above the outer face. The shim elements may be arcuate elements. In another embodiment, compressible shim fingers are utilized. These Finger shims may further include pads.

23 Claims, 5 Drawing Sheets

BACK-UP SHEAR PLATE FOR METAL FRAME WINDOWS

The present invention relates to a back-up shear plate for metal frame windows.

BACKGROUND OF THE INVENTION

Metal frame windows usually include vertically and horizontally oriented elongated hollow bodies with inwardly disposed wall elements (in a direction towards the glass window pane), front and rear wall elements (which may be exterior and interior faces, respectively) and outer wall elements. The outer wall elements are opposite the inwardly disposed wall elements. The inwardly disposed wall elements form an inwardly facing U-shaped or C-shaped channel adapted to retain a window pane therein. The window pane is placed in the U-shaped or C-shaped channel with a gasket, caulk or other type of sealant placed along the front and rear intersecting joints between the U-shaped channel of the metal window frame and the glass pane.

The metal window frame elements, which are the aforementioned elongated hollow bodies, surround the periphery of the window pane. Although reference herein is made to a singular window frame elongated hollow body, the back-up shear plate described herein is used at predetermined locations on each of the horizontal window frame members and vertical window frame members. Typically, back-up shear plates are placed four inches from each corner of the metal window frame and nine inches from the mid-point of each window frame run, that is, nine inches on either side of the center point of the upper and lower horizontal window-frame elements and the left and right vertical window frame elements.

Back-up shear plates are customarily made of aluminum. The aluminum shear plate is extruded to form a base plate having laterally disposed interlockable members (generally female edge members) which interact with the opposing lateral wall elements forming the outwardly facing mouth of the elongated window frame hollow body. The prior art aluminum shear plates are cut in approximately four inch lengths (the longitudinal aspect of the plate) and then placed on a window frame element to cover select portions of the outwardly facing mouth of the metal window frame elongated hollow body member. Prior art aluminum back-up shear plates have a tendency to slide in the mouth of the hollow body frame. Accordingly, installers of windows were required to manually crimp at least two and typically four corners of the aluminum back-up shear plate. Further, prior art aluminum shear plates require two sets of drill bits. The first drill bit is used to drill through the aluminum back-up plate and the second drill bit is used to create a hole for the masonry screw which mounts the metal frame to a concrete column.

Also, prior art aluminum back-up shear plates do not include any self shimming elements. As known in the window installation business, after the rough opening of the window is measured, the metal window frame is constructed from extruded aluminum frame elements and then is installed in the rough opening using back-up shear plates and a plurality of shims. The shims may be wood or other types of readily available construction material. The shims are utilized to level and plum the window in the rough opening and to secure the window in the frame from shear forces. The back-up shear plates are mounted with masonry screws extending through the metal window frames, the back-up shear plates and into the vertical columns and horizontal header and footer to prevent the metal window frame from moving in the rough opening. Shear is an action or stress resulting from applied forces that cause or tend to cause two contiguous parts to slide relative to each other in a direction parallel to their plane of contact.

The present invention solves the problem of utilizing two drill bits, crimping the aluminum back-up shear plate, and, in some instances, provides self shimming structures for the window frame.

OBJECTS OF THE INVENTION

It is an object of the present invention to provide a plastic back-up shear plate for metal window frames.

It is another object of the present invention to provide a back-up shear plate which includes self shimming elements.

It is a further object of the present invention to provide a plastic back-up shear plate which includes support ribs for the window pane channel.

It is a further object of the present invention to provide a back-up shear plate which is spring fit into the outwardly facing mouth of the metal window frame in order to avoid further manipulation (crimping) of the shear plate in the metal window frame.

SUMMARY OF THE INVENTION

The plastic back-up shear plate is laterally disposed with generally a spring fit into the outwardly facing mouth of a metal window frame. The outwardly facing mouth is formed and defined by the window frame elongated hollow body and particularly by outer wall elements which face each other in an opposing manner. The plastic back-up shear plate has laterally disposed opposite outer edge portions which are interlockable on corresponding outer wall elements of hollow body metal window frame which wall elements define the mouth of the window frame. The plastic back-up shear plate has a lateral dimension slightly larger than the lateral mouth dimension and thereby achieves a spring fit. In one embodiment, the plastic back-up shear plate includes support ribs on its inner base plate face. In another embodiment or a further enhancement of the invention, the outer base face of the plastic back-up shear plate includes at least one, and preferably two, shim elements which rise above the flat outer base face out of the base plane of the plastic back-up shear plate. The shim elements may be configured as arcuate elements spanning a reasonable portion of the flat outer base face. In another refined embodiment, compressible shim elements are fingers having a proximal joint supported on the outer base face and a finger body rising above the outer base face. These finger shims may further include finger pads on distal ends opposite the base joints. The finger bodies may arcuately define a concave form with the outer base face. The finger pads may have a convex arcuate shape as compared to the concaved shaped finger bodies.

BRIEF DESCRIPTION OF THE DRAWINGS

Further objects and advantages of the present invention can be found in the detailed description of the preferred embodiments when taken in conjunction with the accompanying drawings in which:

FIGS. 4 and 5 diagrammatically illustrate a side view and a top view of the inner base plate face of one embodiment of the back-up shear plate in accordance with the principles of the present invention;

FIGS. 6 and 7 diagrammatically illustrate cross-sectional or end views of the plastic back-up shear plate having arcuate compressible shim members;

FIG. 8 diagrammatically illustrates an outer base face view with the compressible shim elements mounted laterally on the plastic back-up shear plate;

FIG. 9 is an end view and FIG. 1D is a top view, both which diagrammatically illustrate another arcuate compressible shim and the location of the pair of compressible shims on the outer base face of the plastic back-up shear plate in accordance with the principles of the present invention;

DETAILED DESCRIPTION OF THE PREFERRED EMBODIMENTS

The present invention relates to a plastic back-up shear for a metal window frame.

Figure 1:
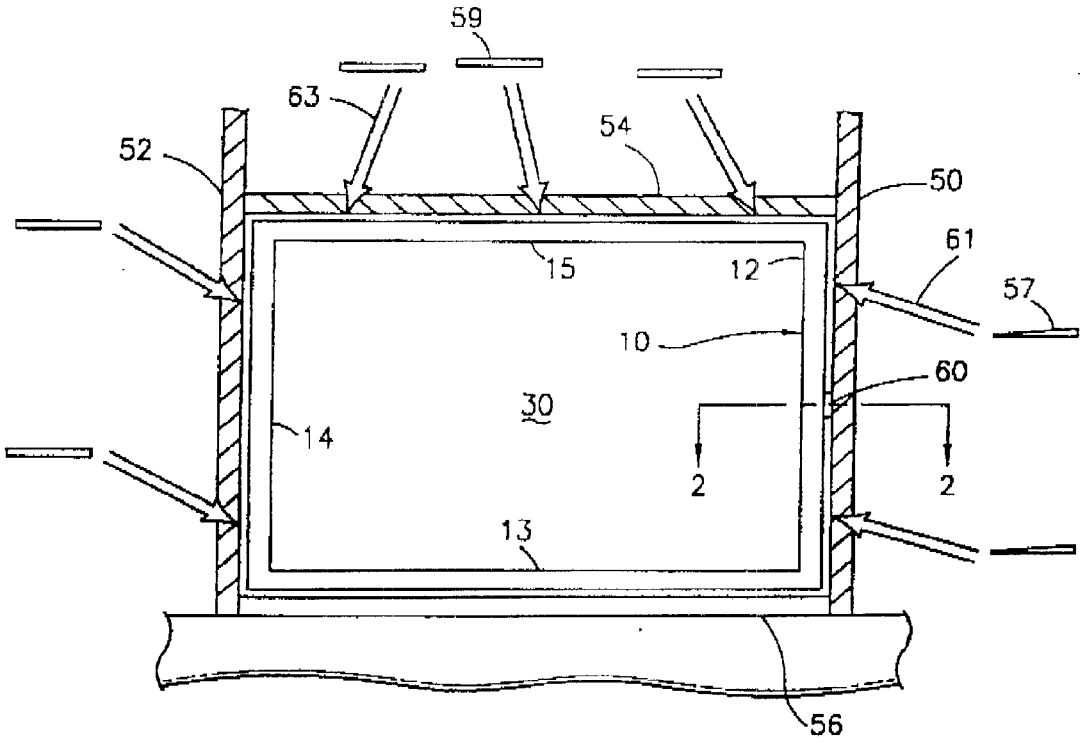
FIG. 1 diagrammatically illustrates a metal window frame (with or without a window pane) mounted in a rough opening of a building or other type of structure.
Figure 2:
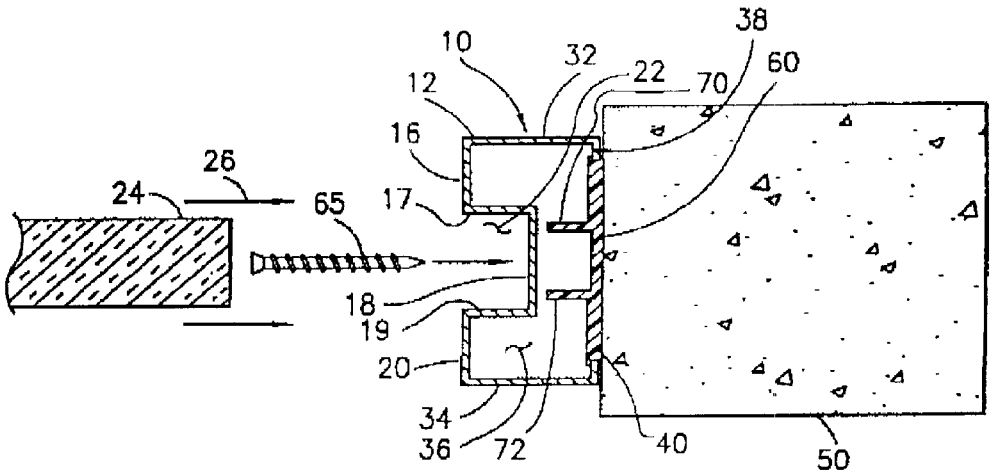
FIG. 2 diagrammatically illustrates one embodiment of the plastic back-up shear plate utilized in connection with the metal window frame in accordance with the principles of the present invention.

FIG. 1 diagrammatically illustrates metal window frame 10 having frame elements 12, 13, 14 and 15. All of the window frame elements 12–15 have generally the same elemental structure. Reference will be made concurrently to FIGS. 1 and 2 herein. FIG. 2 diagrammatically illustrates a cross-section of window frame 10 and specifically vertical window frame element 12 from the perspective of section 2—2 in FIG. 1. Each metal window frame 12, 13, 14, and 15 is an elongated hollow body having inwardly disposed wall elements 16,17, 18, 19 and 20. Inwardly disposed wall elements 17, 18 and 19 form an inwardly facing U-shaped or C-shaped channel 22. A glass window pane 24 is placed in U-shaped channel 22 as shown by arrows 26 in FIG. 2. The direction "inwardly" refers to a direction towards central region 30 of pane 24 and is shown as the mid-point of the window in FIG. 1. In a similar manner, the term "outer" or "outwardly" refers to a direction opposite the central pane region 30.

Figure 3:
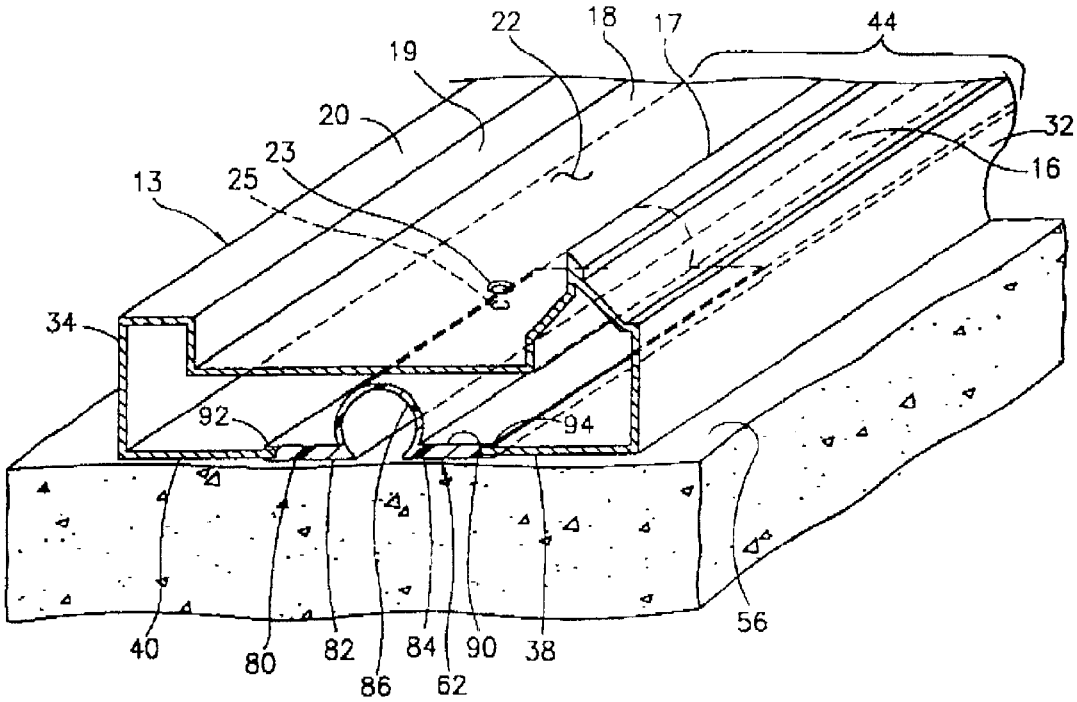
FIG. 3 diagrammatically illustrates another embodiment of the plastic back-up shear plate in accordance with the principles of the present invention wherein the plastic shear plate is mounted beneath a metal window frame adjacent a footer beam.

Metal window frame element 12 also includes a front wall element 32 and the rear wall element 34. The metal window frame is generally hollow as shown by cavity 36 in FIG. 2. The metal window frame 12 also includes outer wall elements 38, 40 which face towards each other and form an outwardly facing mouth. Mouth 44 is best illustrated in FIG. 3. Similar numerals designate similar items throughout all the drawings.

In order to mount metal window frame 10 in the rough opening established by vertical columns 50, 52 and header 54 and footer 56, the plastic back-up shear plate 60 is mounted at various locations on frame elements 12, 13, 14 and 15. The metal window frame 10 with the snap fit shear plate 60 is placed in the rough opening, the frame is plumed and leveled via a plurality of shims, two of which are identified as shims 57, 59 along the horizontal and vertical frame elements. FIG. 1 diagrammatically illustrates via arrows 61, 63 where shims 57, 59 may be placed in order to plum and level window frame 10 in the rough opening formed by columns 50, 52 and header 54 and footer 56. Either before, during or after the shimming operation, frame 10 and particularly window frame element 12 is drilled such that a hole is drilled through plastic back-up shear plate 60 and into column 50. Sometimes, column 50 is concrete and therefore a masonry drill bit is utilized to drill the support hole. A masonry drill bit can easily drill through the plastic back-up shear plate 60 made in accordance with the principles of the present invention.

Prior art aluminum back-up shear plates require a soft metal or a wood drill bit. A masonry drill bit cannot effectively drill through the aluminum back-up shear plate. However, a masonry drill bit is required to provide a lead hole for masonry screw 65.

Masonry screw 65 (FIG. 2) extends through U-shaped channel 22 and particularly inwardly disposed wall element 18, through a central region of plastic back-up shear plate 60 and into concrete column 50. Back-up shear plate 60 in addition to shims 57,59 supports the metal window frame and also the glass window in the building or other structure.

Various features of plastic back-up shear plate 60 and other embodiments of shear plate 60 are discussed later in connection with FIGS. 3–15. However, in FIG. 2, the illustrated plastic back-up shear plate 60 includes an underlying support structure for the U-shaped channel 22. In this embodiment, the underlying support structure is a pair of upstanding ribs 70, 72 which restrict the outward movement of wall element 18 of U-shaped channel 22 due to insertion of screw 65.

FIG. 3 shows a broken away, perspective view of metal window frame element 13, plastic back-up shear plate 62 and footer 56.

Plastic back-up shear plate 62 includes a laterally disposed base plate 80 having, in this illustrated embodiment, base plate legs 82, 84 and an underlying support structure which is a generally a semi-circular tubular member 86. Support structure configured as tubular member 86 underlies and is immediately below U-shaped channel 22 of metal window frame element 13. In some instances, metal window frame 13 is pre-drilled to include a screw hole 23. In the illustrated embodiment, plastic back-up shear plate 62 has been drilled by the window installer to have a complementary screw hole 25.

The inner base plate face 90 formed by base plate 80, supports the support structure semi-circular tubular member 86. Laterally disposed opposite outer edge portions 92,94 are interlockable on corresponding outer wall elements 38, 40 which define mouth 44 of metal window frame 13.

Figures 4, 5, 6, 7, 8, 9, 10:
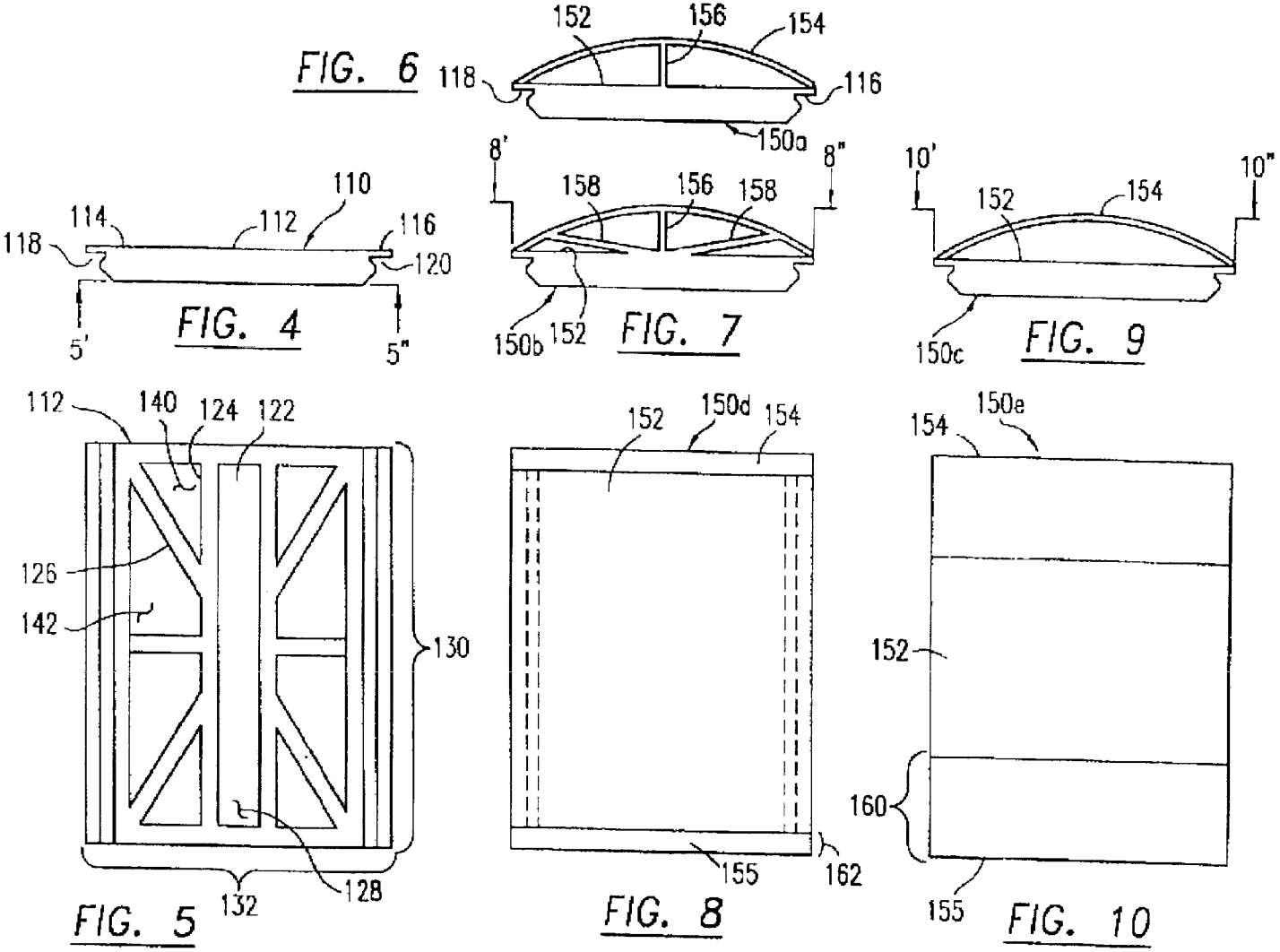

FIG. 4 diagrammatically illustrates a cross-sectional view or an end view of back-up shear plate 110. Back-up shear plate 110 includes a base plate 112 having laterally disposed opposite outer edge portions 114, 116 with interlocking complementary cavities 118, 120 which interlock onto outer wall elements 38, 40 of the metal window frame. Plastic back-up shear plate 110 has a flat outer base face 112 and a generally flat inner back plate face 122. This is shown in FIG. 5.

FIG. 5 also shows support ribs, two of which are identified as support ribs 124 and 126. Support ribs rise above inner back plate face 122 except for a longitudinal central run 128 running through a centrally located longitudinal region 130 of shear plate 112. The lateral dimension 132 is slightly larger than the lateral dimension of window frame mouth 44 (FIG. 3). Accordingly, the shear plate of the present invention is tightly interfit into the mouth of the metal window frame. This tight interfit or spring fit reduces or eliminates the possibility that the plastic shear plate will move relative to the metal window frame after it is placed in the mouth. Typically, the longitudinal extent 130 of the shear plate is 2–4 inches. Accordingly, the back-up shear plate occupies a small portion of the entire run of the metal window frame element.

In FIG. 5, support ribs 124, 126 form several geometric patterns which include a triangular geometric pattern in region 140 and a polygonal pattern in region 142. Of course, polygonal pattern 142 may be square, rectangular or other type of geometric pattern. Support ribs 124 and 126 provide additional strength to the plastic back-up shear plate 112. The clear longitudinal central run 128 on the inner back plate face 122 permits the masonry drill bit to easily pass through the central region. It should be noted that if the metal window frame element 13 is pre-drilled as shown by hole 23, it is relatively easy to place the plastic back-up shear plate 62, 112, in the appropriate location. However, the plastic back-up shear plate 62, 112, must be drilled with a masonry bit and that same drill bit is utilized to drill the pilot or screw hole in the concrete column, footer or header.

FIGS. 6, 7 and 9 diagrammatically illustrate compressible shim elements disposed on the flat outer base face of the plastic back-up shear plates 150*a*, 150*b* and 150*c*. FIGS. 8 and 10 diagrammatically show the location of the compressible shim element on the outer base face. FIGS. 6–10 are discussed concurrently herein.

Back-up shear plate 112 may or may not include support ribs 124, 126 shown in FIG. 5. In FIG. 6, back-up shear plate 150*a* as a flat outer base face 152 and a compressible shim elements 154 rising above outer base face 152. Compressible shim element 154 in FIG. 6 is arcuate in nature and extends from interlocking lateral edge 118 to interlocking lateral edge 116. FIG. 9 shows arcuate compressible shim element 154 without a strut on plate 150*c*. FIG. 6 shows shim element 154 with a singular, outwardly rising strut 156. FIG. 7 shows outwardly rising strut 156 on plate 150*b* in addition to two angularly disposed struts 158.

FIG. 8 shows compressible shim elements 154,155 disposed laterally across back-up shear plate 150*d*. In FIG. 10, arcuate compressible shim elements 154, 155 have a greater longitudinal extent 160 on plate 150*e* as compared with the longitudinal extent 162 of the arcuate compressible shim shown in FIG. 8.

In operation, compressible shims 154, 155 are utilized to replace one or more of shims 57, 59 diagrammatically illustrated in FIG. 1. Since the plastic back-up shear plate of the present invention is made of plastic and can be easily manufactured and distributed to window frame installers, a selection ofback-ups shear plates are available. Some ofthose back-up shear plates have flat outer base face 112 as shown in FIG. 4 and other back-up shear plates have various compressible shim elements 154, 155 shown in FIGS. 6–10.

Figure 11:
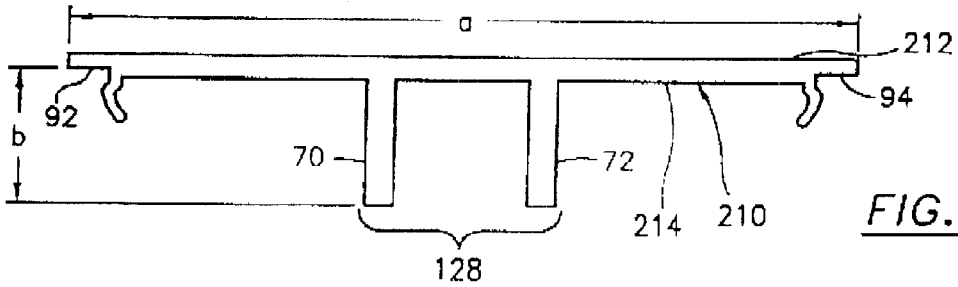
FIG. 11 diagrammatically illustrates an end view of another embodiment of the plastic backup shear plate having support ribs rising above the inner back plate face to support the U-shaped or C-shaped channel on the metal window frame.

FIG. 11 diagrammatically illustrates a plastic back-up shear plate 210 having a flat outer base face 212, a flat inner back plate face 214 and a pair of upstanding ribs 70,72 which provide a support structure about a longitudinal central run 128 of shear plate 210. The support structure established by upstanding ribs 70,72 is utilized to support the U-shaped channel 22 shown in FIG. 2 when screw 65 is utilized to mount window frame 10 on column 50. Shear plate 210 also includes laterally disposed opposite outer edge portions 92, 94.

Figure 12:
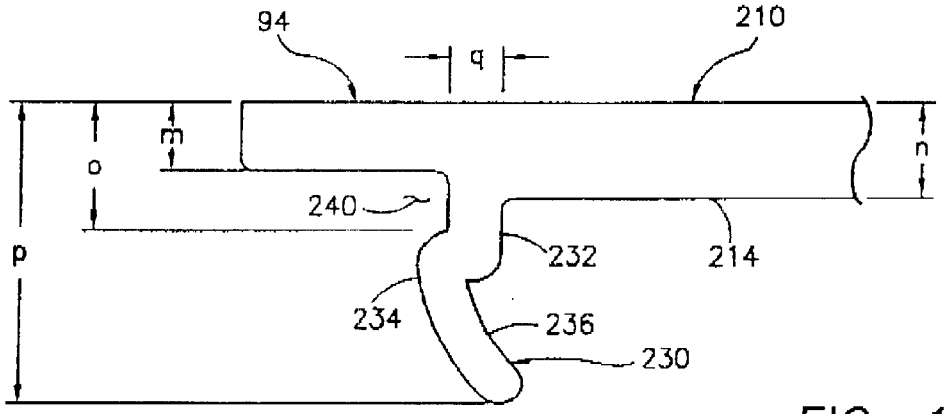
FIG. 12 is an enlarged, cross-sectional end view of an outer edge portion of the plastic back-up shear plate which is interlockable with the outer-wall elements which define the mouth of the metal window frame; and, FIGS. 13, 14 and 15 diagrammatically illustrate end views of the plastic back-up shear plate having compressible shim elements as arcuate fingers with finger pads, a detail of one of the finger shims and a detail of the interlockable edge portion of the plastic back-up shear plate.

FIG. 12 shows a detailed view of outer edge portion 94 and particularly interlock finger 230. Interlock finger 230 includes a normal or perpendicular base 232, a joint 234 and an angularly disposed stub 236. Normal base member 232 and angularly disposed stub 236 extend inward and rise above inner back plate face 214. The edge of the mouth defining first and second wall segments 38, 40 (FIG. 3) are trapped in region 240.

The following Exemplary Dimension Table provides some general dimensions for the plastic back-up shear plate.

| Exemplary Dimension Table (approximate) (in.) | |
|---|---|
| a | 4 |
| overall length | 2.5–4 |
| b | 0.85 |
| m | 0.1 |
| n | 0.125 |
| o | 0.2 |
| p | 0.8 |
| q | 0.6 |
| r | 0.7 |

Figure 13:
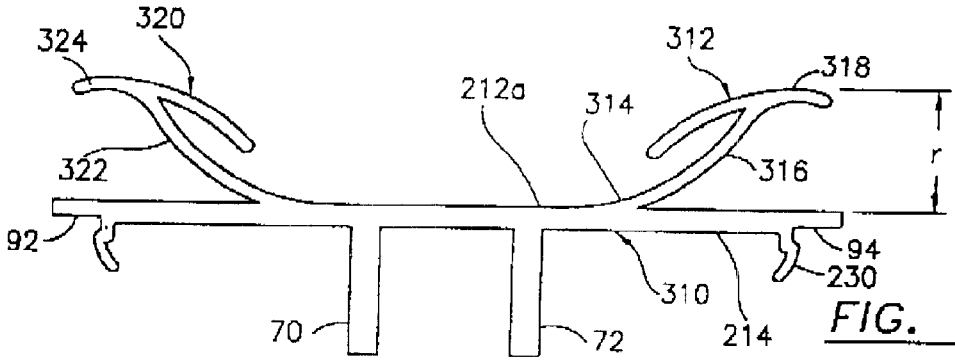
Figure 14:
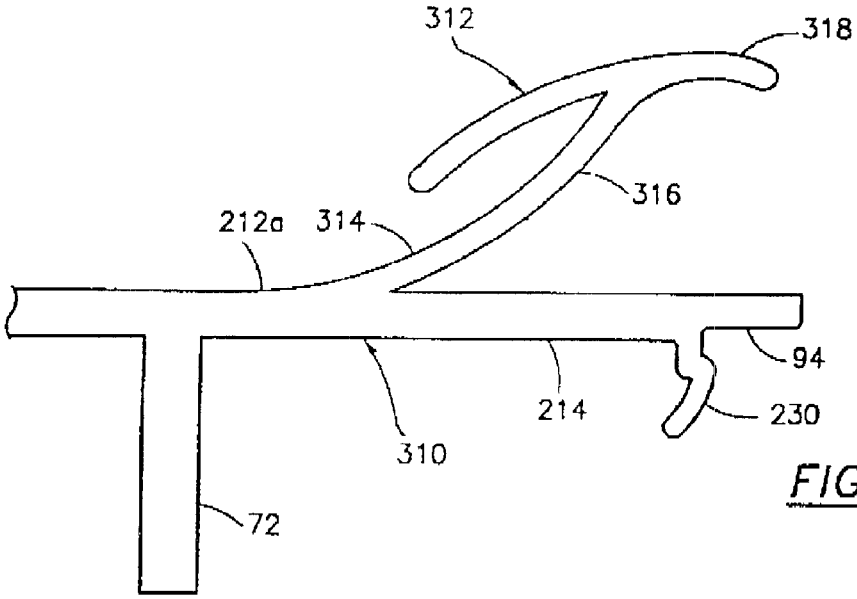
Figure 15:
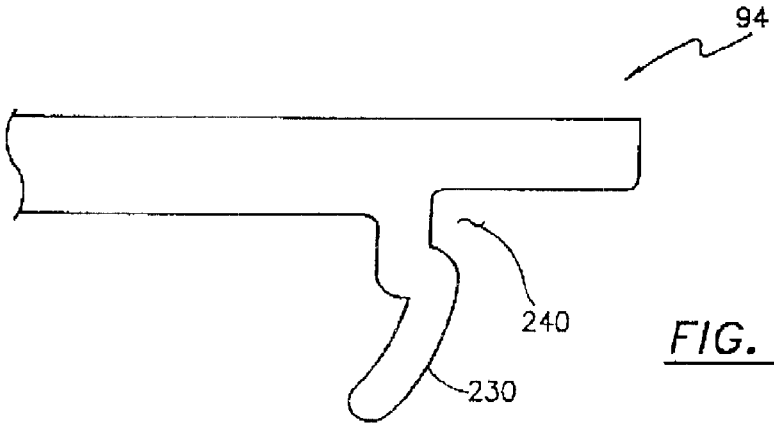

FIGS. 13–15 diagrammatically illustrate other type of compressible shim elements. Plastic back-up shear plate 310 includes a compressible shim element in the form of a resilient finger 312. Resilient finger member 312 includes a base joint 314, a compressible and a resilient body member 316 and a finger pad 318. Compressible finger member 312 has, in this illustrated embodiment, a complementary finger shim member 320. Finger bodies 316 and 322 of fingers 312, 320, in association with outer base face 212*a* form a concave shim structure. Other types of compressible finger member shapes may be utilized.

Finger pads 312 and 324 are generally convex in shape as compared with finger bodies 316, 322. Other shapes for the finger pads may be utilized. FIGS. 14 and 15 show detailed views of resilient finger shims 312 and interlock edge regions 94.

What is claimed is:

1. A back-up shear plate in combination with a metal window frame having an elongated hollow body with inwardly disposed wall elements, front and rear wall elements and outer wail elements said inwardly disposed wall elements forming an inwardly facing U-shaped channel adapted to retain a window therein said outer wall elements including first and second opposing wall segments laterally extending towards each other to define a span therebetween as a mouth, said mouth spaced apart from said U-shaped window channel, the back-up shear plate comprising:

a laterally disposed basic plate sized to snap fit onto and extend said span of said first and second opposing wall segments with said base plate being disposed in said mouth and spaced apart from said U-shaped window channel, said base plate having laterally disposed opposite outer edge interlock portions, said interlock portions adapted to interlock on corresponding ones of said first and second opposing wall segments; and said base plate made of a plastic material.

2. The combination as claimed in claim 1 wherein said mouth has a substantially constant lateral dimension over a longitudinal expanse of said elongated, hollow body window frame, said base plate having a lateral dimension slightly larger that the lateral mouth dimension of said window frame.

3. The combination as claimed in claim 2 wherein said base plate has a flat, outer face which is adapted to close said mouth of said window frame and said base plate has an inner face which includes a plurality of support ribs thereon excepting a longitudinal central run on said inner face of said base plate.

4. The combination as claimed in claim 3 wherein each of said support ribs has a substantially rectangular cross-section and said support ribs form at least one polygonal pattern on said inner face.

5. The combination as claimed in claim 1 wherein said base plate has a flat outer face which is adapted to close said mouth of said window frame and includes at least one compressible shim element rising above said flat outer face of said base plate, said shim element compressible towards said flat outer face of said base plate.

6. The combination as claimed in claim 5 wherein said shim element is an arcuate clement rising above said flat outer face.

7. The combination as claimed in claim 6 wherein said arcuate shim element is further supported by at least one strut extending between an underlying portion of said flat outer face and said arcuate shim element.

8. The combination as claimed in claim 5 wherein said compressible shim element is a pair of compressible shim elements, each shim element disposed at opposing edge locations of said base plate on said flat outer face of said base plate.

9. The combination as claimed in claim 5 wherein said compressible shim element is a pair of compressible shim elements and each said compressible shim element defines a resilient finger member having a joint slip ported on said outer face of said base plate and a finger body rising above said outer face.

10. The combination as claimed in claim 9 wherein each said finger body is arcuately shaped.

11. The combination as claimed in claim 10 wherein the pair of finger members arc mounted on edge regions of said outer face and generally define a concave shape with said outer face.

12. The combination as claimed in claim 11 wherein each said finger member includes a finger pad at a distal end thereof opposite said joint.

13. The combination as claimed in claim 12 wherein each said finger pad is arcuately shaped.

14. The combination as claimed in claim 13 wherein each said arcuate finger pad has a convex shape as compared a respective one of said shaped finger bodies.

15. The combination as claimed in claim 9 wherein each said finger member includes a finger pad at a distal end therest opposite said joint.

16. The combination as claimed in claim 15 wherein each said finger pad is arcuately shaped.

17. The combination as claimed in claim 9 including an underlying support structure on an inner face of said base plate, said underlying support structure adapted to cooperate with said U-shaped window channel.

18. The combination as claimed in claim 17 wherein said support structure is a pair of upstanding ribs said support structure disposed about a longitudinal central axis of said plate.

19. The combination as claimed in claim 1 including an underlying support structure on an inner face of said base plate, said underlying support structure adapted to cooperate with said U-shaped window channel.

20. The combination as claimed in claim 19 wherein said support structure is one of a generally semi-circular tubular member and a pair of upstanding ribs, said support structure disposed about a longitudinal central axis of said base plate.

21. The combination as claimed in claim 5 wherein said mouth has a substantially constant lateral dimension over a longitudinal expanse of said elongated, hollow body window frame, said base plate having a lateral dimension slightly larger than the lateral mouth dimension of said window frame.

22. The combination as claimed in claim 21 wherein said base plate has an inner face which includes a plurality of support ribs thereon excepting a longitudinal central run on said inner race of said base plate.

23. The combination as claimed in claim 22 wherein each of said support ribs has a substantially rectangular cross-section and said support ribs form at least one polygonal pattern on said inner face.

* * * * *